US009643831B1

(12) United States Patent
Al-Assfoor

(10) Patent No.: US 9,643,831 B1
(45) Date of Patent: May 9, 2017

(54) CERAMIC WATER COOLER

(71) Applicant: Esa M. S. E. Al-Assfoor, Safat (KW)

(72) Inventor: Esa M. S. E. Al-Assfoor, Safat (KW)

( * ) Notice: Subject to any disclaimer, the term of this patent is extended or adjusted under 35 U.S.C. 154(b) by 0 days.

(21) Appl. No.: 15/199,860

(22) Filed: Jun. 30, 2016

(51) Int. Cl.

| | |
|---|---|
| ***B67D 1/00*** | (2006.01) |
| ***B67D 7/14*** | (2010.01) |
| ***B67D 1/08*** | (2006.01) |
| ***F25D 31/00*** | (2006.01) |
| ***F25D 29/00*** | (2006.01) |
| ***F25D 23/02*** | (2006.01) |
| ***F25D 23/00*** | (2006.01) |
| ***F25D 11/00*** | (2006.01) |

(52) U.S. Cl.
CPC ..... *B67D 1/0857* (2013.01); *B67D 1/0004* (2013.01); *F25D 11/00* (2013.01); *F25D 23/006* (2013.01); *F25D 23/026* (2013.01); *F25D 29/005* (2013.01); *F25D 31/002* (2013.01); *F25D 2321/1442* (2013.01); *F25D 2323/121* (2013.01)

(58) Field of Classification Search
CPC ..... B67D 1/0857; B67D 1/0004; F25D 11/00; F25D 23/006; F25D 23/026; F25D 29/005; F25D 31/002; F25D 2321/1442; F25D 2323/121; F25D 23/126; B65D 3/009
USPC ..... 222/67, 105, 146.6; 62/389; 137/409, 137/434
See application file for complete search history.

(56) References Cited

U.S. PATENT DOCUMENTS

| | | | | | |
|---|---|---|---|---|---|
| 231,597 | A | * | 8/1880 | Matthews | A47G 19/24 222/173 |
| D89,526 | S | * | 3/1933 | Alex | D7/306 |
| 1,972,079 | A | * | 9/1934 | Erbach | F25D 31/002 62/220 |
| RE20,259 | E | * | 2/1937 | Nave | F25D 31/002 62/297 |
| 2,240,528 | A | * | 5/1941 | Tanner | F25D 11/00 220/DIG. 8 |
| 2,502,589 | A | * | 4/1950 | Rabjohn | B67D 3/0009 165/109.1 |
| 2,513,610 | A | * | 7/1950 | Williams | F25D 31/002 62/392 |
| 2,554,638 | A | * | 5/1951 | Riedel | F25D 31/002 62/201 |
| 2,706,385 | A | * | 4/1955 | Topping | F25C 1/145 222/146.6 |

(Continued)

FOREIGN PATENT DOCUMENTS

WO WO 2014/002005 A2 1/2014

OTHER PUBLICATIONS

AOK Alkaline Water Cooler, http://www.aokwater.com/product.asp?id=23 retrieved from internet, Feb. 10, 2016.

*Primary Examiner* — J. Casimer Jacyna
*Assistant Examiner* — Benjamin R Shaw
(74) *Attorney, Agent, or Firm* — Richard C. Litman

(57) ABSTRACT

The ceramic water cooler includes a conventional refrigeration unit and an internal reservoir for storing water. The internal reservoir can be formed from a ceramic material. Air passes through the porous walls of the internal reservoir to make the water stored therein alkaline. The refrigeration unit cools the water. The cooler includes a float valve for ensuring the reservoir remains full. A tap is provided for dispensing the cool alkaline water held in the reservoir.

1 Claim, 2 Drawing Sheets

(56) References Cited

U.S. PATENT DOCUMENTS 2,739,461 A * 3/1956 Canter ..... F25D 31/002 222/179
3,250,433 A * 5/1966 Christine ..... B67D 3/0009 222/131
3,312,083 A * 4/1967 Scoggins ..... B67D 1/0857 62/389
4,145,291 A * 3/1979 Console ..... A61L 2/18 210/232
4,255,937 A * 3/1981 Ehrlich ..... C02F 1/18 62/264
4,737,358 A 4/1988 Suzuki
4,792,059 A * 12/1988 Kerner ..... B67D 3/00 222/129.1
6,615,607 B1 * 9/2003 Lee ..... A23B 7/0425 62/371
6,988,639 B2 * 1/2006 Arch ..... F16L 41/08 222/105
7,507,334 B1 3/2009 Sigona
7,601,204 B2 * 10/2009 Woodruff ..... B03C 3/017 95/73
D677,967 S * 3/2013 Godinger ..... D7/301
D734,086 S * 7/2015 Tseng ..... D7/306
D737,090 S * 8/2015 Long ..... D23/207
D759,194 S * 6/2016 Wei ..... D23/207
2002/0170921 A1 * 11/2002 Tan ..... B67D 1/1247 222/67
2003/0071069 A1 4/2003 Shelton
2004/0099689 A1 * 5/2004 Almond ..... B67D 3/0009 222/146.6
2004/0129723 A1 * 7/2004 Meder ..... B01D 3/02 222/113
2005/0000984 A1 * 1/2005 Tan ..... B67D 1/0009 222/67
2005/0194404 A1 * 9/2005 Perdue ..... B67D 1/0004 222/146.1
2008/0196422 A1 * 8/2008 Lee ..... B67D 1/0857 62/129
2011/0289947 A1 * 12/2011 Chadwell ..... B67D 1/0862 62/115
2012/0055953 A1 * 3/2012 Shiotani ..... B67D 3/0009 222/67

* cited by examiner

CERAMIC WATER COOLER

BACKGROUND OF THE INVENTION

1. Field of the Invention

The present invention relates to water coolers, and particularly to a water cooler having a conventional refrigeration unit and an internal reservoir formed from a ceramic material.

2. Description of the Related Art

There are several types of cabinet type water dispensers in use today. One of the most common types of such water dispensers is a floor standing cabinet having an open top for receiving a large inverted bottle. The bottle is typically made of a plastic or glass material and has a constricted neck. The bottle is turned upside down and placed on the top of the cabinet with the neck of the bottle extending into a water filled reservoir so that the water seeks its own level in the reservoir during use. As a user draws water from a spigot dispenser, the liquid level in the reservoir drops until it falls below the neck of the bottle at which time water flows from the bottle and bubbles enter the bottle until pressure has equalized. Inverted bottle type water dispensers are sold by a number of companies in the United States and elsewhere. These types of dispensers are undesirable in that they may not provide sanitized water with sufficient alkalinity.

Thus, a ceramic water cooler solving the aforementioned problems is desired.

SUMMARY OF THE INVENTION

The ceramic water cooler includes a conventional refrigeration unit and an internal reservoir formed from a ceramic material, of the type used to make pottery. The cooler includes a float valve for ensuring the reservoir remains full. A tap is provided for dispensing the cool alkaline water held in the reservoir. A basin under the reservoir catches the water seeping through the ceramic. The combination of a porous ceramic (or "pottery" type) basin/reservoir and a refrigeration unit makes the water alkaline for health and nutritional purposes and cool for drinking purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
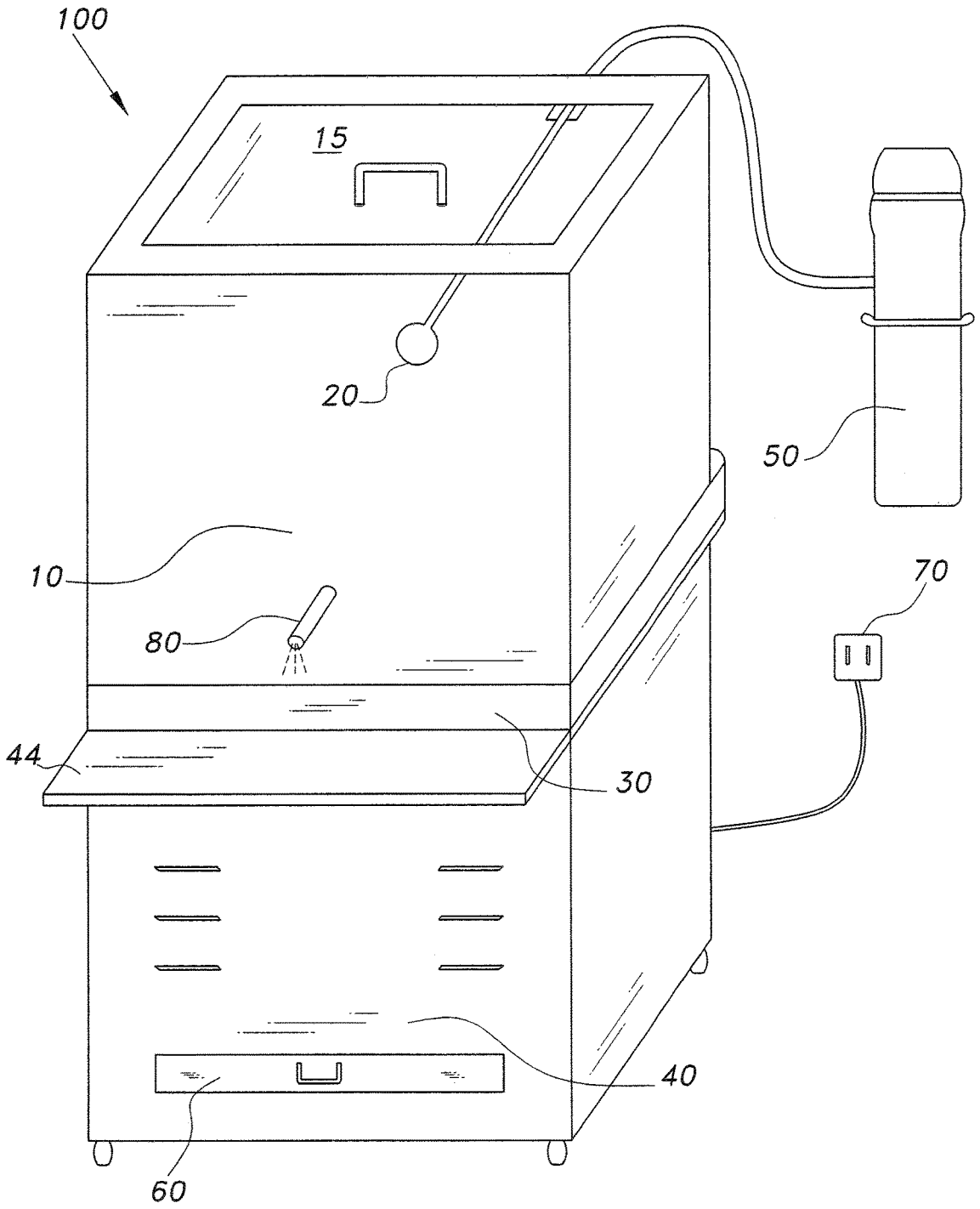
FIG. 1 is a perspective view of the ceramic water cooler, according to the present invention.

As shown in FIG. 1, the ceramic water cooler 100 includes a box shaped housing including a hollow upper reservoir 10 for storing water. The upper reservoir 10 can be made from a porous material, such as a ceramic material. A float valve 20 is disposed in the reservoir 10 to ensure the reservoir 10 remains full of water. The water supply to the reservoir 10 is filtered by a filter canister 50 which can be connected to the on/off valve float 20. Water dispensing spigot 80 extends from the front portion of the housing 10. Disposed between upper reservoir housing 10 and refrigeration unit/compressor housing 40 is a cooling cavity 30. The cooling cavity 30 is in communication with both the reservoir 10 and the compressor housing 40. The cooling cavity 30 receives cooling air from the compressor housing 40. The cooled air in the cooling cavity is transferred to the reservoir 10. The compressor housing 40 and other electrical components associated with ceramic water cooler 100 are powered from the AC mains via a cord connected to electrical plug 70. The refrigeration unit 40 cools the water in the housing 40. A door 15 to the upper reservoir 10 is disposed on a top surface of the reservoir 10. A collector 60 slidably attached to the bottom of the compressor housing 40 collects waste water emanating from the upper reservoir 10.

Figure 2:
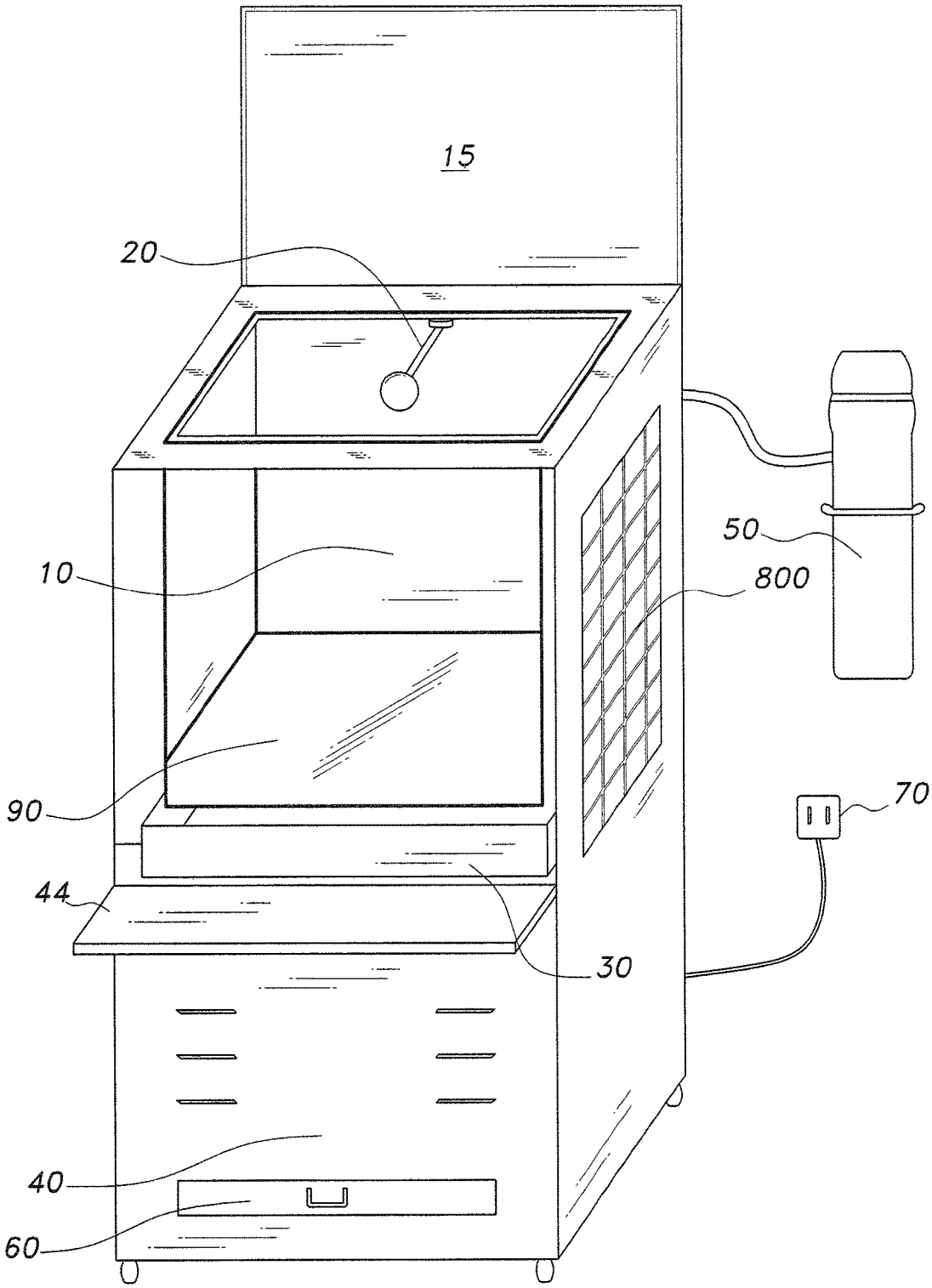
FIG. 2 is a perspective view of the ceramic water cooler with lattice, according to the present invention.

The ceramic reservoir 10 is porous to allow air to enter the reservoir 10. As shown in FIG. 2, a protective liner 90 can be disposed on a bottom inside portion of the upper reservoir 10. The ceramic reservoir 10 can be disposed within an outer cooler housing. A resilient lattice 800 can be disposed on a side of the cooler housing to permit air to reach the upper reservoir 10. The outer cooler housing can protect the reservoir 10 against breakage. A dispensing shelf 44 extends from the compressor housing 40 below the water dispensing spigot 80.

Upon sufficient exposure to air (typically about thirty minutes), water in the reservoir 10 becomes alkaline. Accordingly, water dispensed from the reservoir 10 can be alkaline for health and nutritional purposes and cool for drinking purposes.

It is to be understood that the present invention is not limited to the embodiments described above, but encompasses any and all embodiments within the scope of the following claims.

I claim:

1. A water cooler, consisting of:

a housing having an upper section and a lower section;

the upper section includes a ceramic reservoir;

the lower section includes a refrigeration unit;

a protective liner disposed on an internal bottom surface of the ceramic reservoir an access door disposed on a top portion of the housing;

a water dispensing spigot extending from a front portion of the housing;

a valve float disposed inside the ceramic reservoir to regulate water level inside the reservoir;

a water filter connected to the reservoir by a water supply line;

a collector slidably attached to a bottom portion of the refrigeration unit;

wherein the collector collecting water emanating from the upper section;

a cooling cavity disposed between the upper reservoir and the refrigeration unit; and a dispensing shelf extending from the refrigeration unit below the water dispensing spigot.

* * * * *